US011221181B2

(12) United States Patent
Denollin

(10) Patent No.: US 11,221,181 B2
(45) **Date of Patent: *Jan. 11, 2022**

(54) METHOD FOR HANDLING A SLAG POT OR LADLE AND PYROMETALLURGICAL TOOLS

(71) Applicant: S.A. Lhoist Recherche et Developpement, Ottignies-Louvain-la-Neuve (BE)

(72) Inventor: Guillaume Denollin, Havre (BE)

( * ) Notice: Subject to any disclaimer, the term of this patent is extended or adjusted under 35 U.S.C. 154(b) by 66 days.

This patent is subject to a terminal disclaimer.

(21) Appl. No.: 16/467,161

(22) PCT Filed: Dec. 7, 2017

(86) PCT No.: PCT/EP2017/081823

§ 371 (c)(1),
(2) Date: Jun. 6, 2019

(87) PCT Pub. No.: WO2018/104447

PCT Pub. Date: Jun. 14, 2018

(65) Prior Publication Data

US 2019/0376746 A1 Dec. 12, 2019

(30) Foreign Application Priority Data

Dec. 8, 2016 (BE) ..... 2016/5908

(51) Int. Cl.
*F27D 3/15* (2006.01)
*C21B 3/10* (2006.01)

(52) U.S. Cl.
CPC ..... *F27D 3/1545* (2013.01); *C21B 3/10* (2013.01)

(58) Field of Classification Search
CPC ..... C21B 3/10; F27D 3/1545
See application file for complete search history.

(56) References Cited

U.S. PATENT DOCUMENTS

| | | | | |
|---|---|---|---|---|
| 3,243,397 | A * | 3/1966 | Herkimer | B22C 3/00 523/147 |
| 4,131,265 | A * | 12/1978 | McCray | B22D 41/04 266/275 |
| 5,300,144 | A * | 4/1994 | Adams | B22C 1/26 106/124.2 |
| 5,437,890 | A | 8/1995 | Gramke | |
| 2011/0000403 | A1 | 1/2011 | Tilquin et al. | |
| 2019/0316844 | A1* | 10/2019 | Denollin | F27D 1/0006 |
| 2019/0376746 | A1* | 12/2019 | Denollin | F27D 3/1545 |

FOREIGN PATENT DOCUMENTS

| | | | |
|---|---|---|---|
| EP | 1840097 | A1 | 10/2007 |
| GB | 1401821 | A | 8/1975 |
| JP | 085260 | A | 1/1996 |
| JP | 2015094020 | A | 5/2015 |

OTHER PUBLICATIONS

PCT/EP2017/081823, International Search Report, dated Mar. 20, 2018, 3 pages.

* cited by examiner

*Primary Examiner* — Scott R Kastler

(57) ABSTRACT

A method is shown for handling a slag pot or ladle and pyrometallurgical tools made form steel or cast iron, comprising the steps of spraying a mineral suspension onto a wall and bringing said slag pot or ladle or the pyrometallurgical tool into service, wherein said mineral suspension comprises calcic particles in suspension in an aqueous phase forming a calcic particle milk having a calcic particle content of between 20% and 60% by weight with respect to the weight of said calcic particle milk, said mineral layer being a fine layer.

14 Claims, No Drawings

METHOD FOR HANDLING A SLAG POT OR LADLE AND PYROMETALLURGICAL TOOLS

FIELD OF THE INVENTION

The present invention relates to the field of the handling of slag pots and ladles used in ferrous or non-ferrous metallurgy.

BACKGROUND OF THE INVENTION

Typically, the pyrometallurgy industry produces slag, also known as cinders, which floats above the molten metal bath because of its density lower than that of the molten metal.

The slag is collected in various ways. A first technique lies in the tilting of the pot in which it is supernatant above the molten metal bath. The slag may also be collected by raking or by overflowing during tilting.

It is then recovered in slag pots or ladles, which are typically formed from refractory material, cast iron or steel.

In the ferrous metallurgy industry, there are blast-furnace slags and steelworks slags.

Blast-furnace slag is a by-product resulting from the manufacture of cast iron in a blast furnace, where it corresponds to rocks of the iron ore, to which there are added mineral additions and fuel cinders, in particular of coke, of coal and/or alternative fuels. It is therefore separated from the liquid molten iron by difference in density.

The quantity of slag produced corresponds directly to the richness of the iron ore used. For a blast furnace functioning with ores rich in iron, a proportion of 180 to 350 kg of slag for one tonne of cast iron produced is generally achieved.

Steelworks slag comes from pyrometallurgic tools, such as various refining tools such as tools for desulphurisation of cast iron, the converters transforming the cast iron into steel (BOF—basic oxygen furnace), electric furnaces (EAF—electric arc furnaces), stainless-steel refining converters (AOD—argon oxygen decarburisation) and the various tools for secondary metallurgy grading. For a tonne of steel produced, 50 to 150 kg of steelworks stag is produced.

The function of steelworks slag is to collect together the impurities and the undesirable chemical elements. The latter are in the great majority of cases in the form of oxides. They are generally generated during the use of the pyrometallurgy tool concerned.

For this purpose, it is essential to manage its composition so as to make it reactive. A high lime content will for example make the slag capable of capturing the phosphorus oxides at the converter, which makes it possible to envisage reprocessing it as a fertiliser. In ladle metallurgy a high lime content makes the slag basic, which is favourable to the capture of alumina inclusions. However, this slag must also take care of the refractory bricks.

The present invention relates more particularly to the field of the handling of slag pots and ladles but also crucibles and shells, made from steel or cast iron, used in the workshops for preparing metal in ferrous and non-ferrous metallurgy.

More particularly, the slag involved in the context of the present invention is steelworks slag or slag from non-ferrous metallurgy.

In the context of the present invention, pots, ladles, crucibles, shells and the like made from steel or cast iron intended to collect the steelworks slag or slag from the metallurgical industry will be referred to simply as "slag pots".

In the metallurgical industry, the handling of slag pots is often entrusted to subcontractors, the slag pots forming part of the fabrication often forming part of the metallurgy industry.

Among other things, during the conveying of the slag pots, for reasons of safety, it is necessary to keep the slag pots above 150° C. in order to prevent any accumulation of water. This is because this would cause explosions when the slag itself is poured at a temperature of more than 1200° C. It is consequently normal practice to heat the slag pots before they are brought into service.

During normal use of slag pots, their temperature remains stable and usually above 250° C. by virtue of the accumulation and retention of the heat coming from the slag. The difference in coefficient of expansion between the slag and the cast iron or steel forming the pot should in fact cause shedding when the temperature of the pot fluctuates. However, during normal use, said temperature does not fluctuate sufficiently to cause shedding. Consequently the formation of a "skull" is promoted. The present invention aims among other things to overcome this lack.

Naturally, the formation of a "skull" is inherent in the process and occurs in all cases. However, it may occur to a greater or lesser extent depending on whether or not the handling method is optimum.

The formation of a "skull" also depends on the steelmaking tool that produced the stag. Some being of a physical or chemical nature more liable than others to form skulls.

In addition, when the cleaning of the slag pots takes a long time and it is necessary to "de-skull" (mechanically remove the layer of skull that adheres to the walls of the slag pot), the slag pots cool significantly following exposure to climatic conditions and to the duration of the "de-skulling" process. It is then necessary to reheat subsequently. However, this heating represents a significant and excessively expensive calorific energy in order to make it possible to return to the optimum temperature ranges around 250° C. Thus, generally, after cleaning, the vessels are reheated to around 150° C. for the safety reasons mentioned above.

At the present time, a mineral layer may be deposited on the internal wall of the slag pots. This solution acts mainly on the formation of intermediate slag phases. For example, this mineral layer deposited may involve the formation of an intermediate slag phase by means of an endothermic reaction that provides a cooling effect, or on the contrary the formation of an intermediate phase with a higher melting point, or act on other effects in relation to a phase transformation, such as by acting on the expansion or on contraction.

These techniques mentioned above use mainly refractory suspensions or mineral suspensions of lime and stag in a mixture. However, these suspensions comprise compounds in a mixture, the composition of which has an impact on the composition of the slag, the chemical properties of which are thus modified, such as for example the basicity (determined by the ratio of the quantity of basic elements to the quantity of acidic elements in the solid fraction), a basicity that is modified by adapting the basicity of the suspension according to the basicity of the slag poured into the slag pot or ladle.

Although these technical solutions involving suspensions are currently considered to be functioning correctly, they are also highly dependent on the chemical composition and the homogeneity of the slag that is poured into the slag pots or ladles. Consequently, as the composition of the slags is frankly not always homogeneous, and as its global composition may also vary from one tool to another or even vary over time for the same tool, the composition of these suspensions must also be adapted, which makes the process particularly complex and highly manual. This is for example described in the document U.S. Pat. No. 5,437,890.

The document U.S. Pat. No. 5,437,890 discloses a pretreatment of the walls of slag pots with refractory materials with an essentially mineral mixture comprising lime, slag fines and water in order to prevent the adhesion of slag to the refractory walls, which destroys the walls of the pot.

In the past, sometimes, suspensions of lime were used in this type of application. Workshops in the metallurgy industry then produced roughly a suspension of lime, which had many drawbacks such as for example low efficacy, a great thickness of cladding on the walls, the presence of residual water in the vessel or in the slag pot, which represents a danger, vary dirty and complex and highly manual applications, and finally, these solutions were very expensive in comparison with poor results obtained in terms of simplification of handling.

The documents JP 2015/094020 and the document JPS 63295456 report for example on treatment with lime suspensions.

For example, the document JP 2015/094020 discloses a treatment of the internal surface of slag pots by spraying a suspension of lime to be used in the process of recycling of hot slags during the implementation of the desulphurisation treatment. The pipe spraying the suspension of lime is connected to a lime-suspension reservoir, in which the lime suspension has a lime concentration of 13.5 to 15% by weight with respect to the total weight of lime suspension. The excess of lime suspension and washing water, both sprayed onto the internal surface of the slag pots, returns to the lime-suspension reservoir.

The document JPS 63295458 also discloses that slaked lime is fed onto the walls of the slag pots in order to facilitate the emptying of slag from the pot, when it is cooled and solidified. However, this document does not disclose any characteristic of the lime, or how, or even in what proportion it is applied to the internal wall of the slag pots. In addition, it does not describe anything with regard to the deposition of slag by tipping. On the contrary, according to this document, the solidification of the slag is awaited in order to be able to remove it from the slag pot or ladle.

As can be seen, the existing techniques use either mineral suspensions the composition of which is complex and requires formulation steps that can be adapted to the composition of the slag, or very coarse and uncontrolled mineral suspensions that are in the end not very effective. There therefore remains a need to procure a handling of slag pots or ladles that is optimised, simple to implement and effective.

SUMMARY OF THE INVENTION

The aim of the invention is to overcome the drawbacks of the prior art by procuring a method procuring an optimised pretreatment of steel or cast-iron stag pots and ladles in order to facilitate the handling thereof on pyrometallurgic steelmaking sites between the point of collecting the slag at the steelmaking or pyrometallurgical tool and the tipping of the slag in a deposition site, typically a landfill site.

To solve this problem, a method for handling a slag pot or ladle comprising an internal wall and an external wall is provided according to the invention, said method comprising the steps of:

a) collecting slag in said slag pot or ladle of a pyrometallurgic tool, b) transporting said slag pot or ladle from said pyrometallurgic tool to said slag deposition site, typically to the landfill site, c) emptying said pot or ladle at said slag-deposition site, typically at the landfill site, in order to eliminate the slag that it contains, d) spraying of a mineral suspension on said internal wall of said slag pot or ladle, prior to at least one step of said collection of said slag, so as to line said internal wait with a mineral layer, and e) bringing said slag pot or ladle lined with said mineral layer into service with a view to the collection of the slag a).

The method according to the present invention is characterised in that said stag pot or ladle is a steel or cast-iron pot or ladle and in that said mineral suspension comprises calcic particles in suspension in an aqueous phase forming a calcic-particle milk, and optionally additives, said calcic particles being chosen from the group consisting of slaked lime, at least partially slaked decarbonated dolomite, limestone and mixtures thereof, and having a calcic particle content of between 20% and 60% by weight with respect to the weight of said calcic-particle milk, said mineral layer being a fine layer.

DETAILED DESCRIPTION OF THE INVENTION

Within the meaning of the present invention, the words "brought into service" means that the slag pot or ladle is put in circulation for the role that is expected of a slag pot or ladle, namely the collection of slag.

As can be seen, the method according to the present invention is focused on steel or cast-iron pots.

This is because, in the context of the present invention, the choice relating to slag pots or ladles made from steel or cast iron (rather than from refractory material) makes it possible to take best advantage of the difference in coefficient of expansion between the materials of the metal type forming the slag pots or ladles and the oxides forming the slag.

When milk formed from calcic particles chosen exclusively from the small group consisting of slaked lime, at least partially slaked decarbonated dolomite, limestone and mixtures thereof has a calcic particle content of between 20% and 60% by weight with respect to the total weight of the calcic particle milk is coated on the internal wall of the slag pots or ladles, a fine homogeneous mineral layer is produced and it was found surprisingly that the milk that is poured thereon did not adhere or adhered only very little at the moment of discharge pouring. The layer thus formed acts as a stripping agent forming a layer significantly reducing the formation of skull by significantly reducing the adhesion between the slag pot or ladle and the slag that is poured therein The specific concentration of between 20% and 60% of calcic particles in the calcic-particle milk makes it possible, when calcic-particle milk is sprayed, for the water contained in the suspension to evaporate almost instantaneously in contact with the hot walls and for a layer of calcic particles to be applied and thus form a fine homogeneous layer, which does not act on the concentration of calcic particles in the slag, but also avoids contributing residual water in the slag, which is dangerous for the handling of the slag pot or ladle.

This is because, when the calcic-particle milk is sprayed, the temperature of the pot or ladle is greater than 100° C., which leads to the evaporation of the water contained in the calcic-particle milk and thus leaves a fine homogeneous layer of calcic particles.

Within the meaning of the present invention, the words "slag pot or ladle coated with a mineral layer on a surface" means that approximately 70%, for example more than 80%, in particular more than 85%, or even more than 90% of the surface is coated with a fine mineral layer.

Calcium oxide, CaO, is often referred to as "quicklime", while calcium hydroxide, $Ca(OH)_2$, is called "hydrated lime" or "slaked lime", the two compounds sometimes being informally referred to as "lime". In other words, lime is an industrial product respectively based on calcium oxide or hydroxide.

"Quicklime" means a mineral solid material the chemical composition of which is mainly calcium oxide, CaO. Quicklime is generally obtained by the calcination of limestone (mainly composed of $CaCO_3$).

Quicklime may also contain impurities such as magnesium oxide, MgO, sulphur oxide, $SO_3$, silica, $SiO_2$, or alumina, $Al_2O_3$, etc., the sum of which is an amount of a few % by weight. The impurities are expressed here in their oxide form, but of course they may appear in various phases. Quicklime generally also contains a few % by weight residual limestone, referred to as uncooked residues.

The quicklime that is suitable according to the present invention may comprise MgO, expressed in the form of MgO, in a quantity lying in the range from 0.5% to 10% by weight, preferably less than or equal to 5% by weight, more preferably less than or equal to 3% by weight, preferably above all less than or equal to 1% by weight with respect to the total weight of quicklime.

Typically, in order to form slaked lime, quicklime is used in the presence of water. The calcium oxide in the quicklime reacts quickly with the water in order to form calcium dihydroxide $Ca(OH)_2$, in the form of slaked lime or hydrated lime, in a reaction referred to as hydration or slaking, which is highly exothermic. Hereinafter, calcium dihydroxide will be simply referred to as calcium hydroxide.

Slaked lime may therefore contain the same impurities as those of the quicklime from which it is produced.

Slaked lime may also comprise $Mg(OH)_2$ in a quantity lying in the range from 0.5% to 10% by weight, preferably less than or equal to 5% by weight, more preferably less than or equal to 3% by weight, preferably above all less than or equal to 1% by weight with respect to the total weight of slaked lime.

Slaked lime may also comprise calcium oxide, which may not have been completely hydrated during the slaking step, or calcium carbonate $CaCO_3$. The calcium carbonate may come from the initial (uncooked) limestone from which said slaked lime is obtained (by means of calcium oxide), or come from a partial carbonation reaction of the staked lime by contact with an atmosphere containing $CO_2$.

The quantity of calcium oxide in the slaked lime according to the present invention is generally less than or equal to 3% by weight, preferably less than or equal to 2% by weight and more preferably less than or equal to 1% by weight with respect to the total weight of slaked lime.

The quantity of $CO_2$ in the slaked lime (mainly in the form of $CaCO_3$) according to the present invention is less than or equal to 5% by weight, preferably less than or equal to 3% by weight, more preferably less than or equal to 2% by weight, with respect to the total weight of slaked lime according to the present invention.

Within the meaning of the present invention, the words "milk-of-lime" mean a suspension of solid particles of slaked lime in an aqueous phase at a concentration greater than or equal to 200 g/kg. The solid particles may obviously contain impurities, namely phases derived from $SiO_2$, $Al_2O_3$, $Fe_2O_3$, MnO, $P_2O_5$ and/or $SO_3$, representing globally a few tens of grams per kilogram. These solid particles may also contain calcium oxide that was not hydrated during the staking, just as they may contain calcium carbonate $CaCO_3$ and/or magnesium carbonate $MgCO_3$, possibly combined in the form of dolomite.

By analogy, within the meaning of the present invention, the words "calcic-particle milk" means a suspension of solid calcic particles in an aqueous phase at a concentration greater than or equal to 200 g/kg.

Dolomite comprises both calcium carbonate and magnesium carbonate in variable proportions as well as various impurities. The cooking of dolomite causes the release of $CO_2$ (decarbonation) and a quick dolomitic product is obtained, namely composed mainly of CaO and MgO, although carbonates, especially $CaCO_3$, may remain in greater or lesser quantities. During the slaking for producing at least partially hydrated decarbonated dolomite, water is added in order to hydrate the quick part of the decarbonated dolomite. Since the avidity of CaO for water is much higher than that of MgO for water, it is often necessary to hydrate under pressure, for example in an autoclave, with as a result an at least partially hydrated product. It is in fact normal for some of the MgO to remain in the form of MgO. The Ca/Mg proportions between the oxide, carbonate and hydrate part being highly variable in at least partially hydrated decarbonated dolomite.

The term "limestone" means, within the meaning of the present invention, a natural mineral material issuing from limestone ore or, when the properties must be controlled, issuing from the carbonation of quicklime. Limestone has the general formula $CaCO_3$ and may obviously contain impurities.

In a particular embodiment according to the present invention, calcic-particle milk is a milk-of-lime and said calcic particles are slaked-lime particles.

When the slag is tipped into the slag pot or ladle, it is possible for the slaked-like particles of the mineral layer to transform in situ, wholly or partially, into quicklime. However, in either case, the stripping effect of the mineral layer enables the slag to be discharged, entraining with it the mineral layer and thus leaving the slag pot or ladle perfectly clean for the following operations.

More particularly, when the slag is tipped, the slaked time is in any event transformed into quicklime because of the temperature of the slag, which is above 1200° C. This transformation releases steam, which detaches the tipped slag at numerous attachment points formed between the slag and the internal wall of the slag pot or ladle. This significantly reduces the total surface area of slag adhering to the mineral layer formed by particles of lime.

Even if the coating is applied and the slag pot or ladle is stored for an indeterminate period of time, the mineral layer comprising calcium hydrate carbonates and thus transforms into a layer of calcium carbonate. When the slag is poured onto the calcium carbonate, because of the temperature of the slag above 1200° C., the calcium carbonate is decarbonated and forms quicklime by release of $CO_2$ rather than steam (although the two phenomena may occur simultaneously).

Consequently handling of the slag pots and ladles is simplified since it is no longer necessary to carry out mechanical detachment of skull formed, or to raise the pot or ladle to a sufficient temperature for bringing it into service. Once the slag has been dumped, it is merely necessary to once again vaporise the milk-of-lime.

The fineness of the layer and the homogeneity thereof, being a consequence of the concentration and size of the slaked-lime particles in the milk-of-lime, is obviously of considerable importance in achieving elimination of the mineral layer with the slag during dumping, but also simultaneously in order to achieve the stripping effect.

Advantageously, said calcic particles in the calcic-particle milk of said mineral suspension have a mean particle size $d_{50}$ of between 1.5 μm and 10 μm.

Advantageously, said calcic particles in the calcic-particle milk of said mineral suspension have a mean particle size 6 μm, of less than or equal to 8 μm in particular less than or equal to 6 μm, more particularly less than or equal to 5 μm, quite particularly less than 4 μm.

Advantageously, said calcic particles in the calcic-particle milk of said mineral suspension have a mean particle size $d_{50}$ of greater than or equal to 2 μm, in particular greater than or equal to 2.5 μm.

The notation $d_x$ represents a diameter, expressed in μm, with respect to which X % of the particles or grains measured are smaller.

The finer the particles, the better the reaction of release of steam or $CO_2$ occurs, which allows shedding of the slag as indicated above.

The reactivity of the milks-of-lime is characterised, within the meaning of the present invention, according to the European standard EN 12485 (2010) § 6.11 ("Determination of solubility index by conductivity". This method is itself derived from the work by van Eekeren et al disclosed in the document "Improved milk-of-lime for softening of drinking water", M. W. M. van Eekeren, J. A. M. van Paassen, C. W. A. M. Merks, KIWA NV Research and Consultancy, Nieuwegein, September 1993" produced and distributed by KIWA, Royal Netherland Water Analysis Institute (KIWA NV Research and Consultancy, Groningenhaven 7, PO Box 1072, 3430BB Nieuwegein).

The reactivity of a milk-of-lime is therefore assessed by the change over time in the measurement of the conductivity of a solution prepared by diluting a small quantity of milk-of-lime in a large volume of demineralised water. The points corresponding to a conductivity of x % for x %=63%, 80%, 90% and 95% of the maximum conductivity at the end point are in particular noted (see EN 12485 (2010) § 6.11.6.2). The corresponding dissolution time t(x %) in seconds is then obtained from the conductivity against time graph (see FIG. 2 of EN 12485 (2010)).

It is known that the rate of dissolution of lime particles in demineralised water is faster (t(x %) smaller) when the size of the particles is smaller. In other words, the reactivity of the milk-of-lime is generally higher when its constituent particles are smaller.

In a preferred embodiment of the method according to the present invention, when said mineral suspension contains or is milk-of-lime, it has a reactivity expressed in the form of a dissolution time t(90%) greater than 0.1 seconds, in particular greater than 0.2 seconds and less than 10 seconds, in particular less than 5 seconds.

When the milk-of-lime has such reactivity, the slaked-lime particles have a particle size that is sufficiently fine for also contributing to the formation of a fine mineral layer, in particular homogeneous, participating in the simplification of the stripping of the slag.

Advantageously, said calcic-particle milk has a stability characterised by the bottle test as described in the document WO 2001/096240.

Preferably, said additives of said mineral suspension are chosen from the group consisting of carbohydrates as well as dispersants and fluidifying additives, such as polycarbonates or polyacrylates, or polyphosphonates, in particular DTPMP.

Advantageously, said dispersing of fluidifying additives of said mineral suspension are present in a proportion by mass of between 0.2% and 5% with respect to the weight of said mineral suspension. Preferentially, the proportion of the aforementioned additives is less than or equal to 3%, in particular less than or equal to 2%, more particularly less than or equal to 1.5% with respect to the weight of said mineral suspension. Preferably, the proportion of aforementioned additives is greater than or equal to 0.5%, with respect to the weight of said mineral suspension.

In the case of the presence of a carbohydrate, for example in a proportion of between 0.2% and 3%, preferably between 0.4% and 2%, more preferentially between 0.5% and 1.5%, even more advantageously between 0.5% and 1% by weight with respect to the total weight of said mineral suspension, the mineral suspension is coated on the internal wall of the slag pots or ladles.

Naturally a plurality of the aforementioned additives may be present in said mineral suspension, in particular one or more carbohydrates with one or more dispersing or fluidifying agents.

As mentioned above, at the time of the spraying of the mineral suspension, the water contained in the suspension evaporates almost instantaneously in contact with the hot wall. If the mineral suspension contains a carbohydrate, the evaporation of the water contained in the mineral suspension causes a rapid increase in the carbohydrate concentration until a weak adhesive is formed assisting the adhesion of the calcic particles to the wall of the slag pot, due also to the temperature of the slag pot or ladle, which is above 100° C.

When the slag is poured into the slag pot or ladle, emerging from the furnace, the temperature of the slag produces a reaction of calcination of the carbohydrate, possibly simultaneously with the dehydration of the calcium hydroxide when the calcic particles are slaked-lime particles or at least partially hydrated decarbonated dolomite, which facilitates the stripping of the slag, these phenomena occurring as from 500° C.

This is because the fine mineral layer formed by spraying makes it possible, when slag is poured into the slag pot or ladle, to produce a shear plane behind the mineral layer (at the interface between the internal wall of the slag pot or ladle and the mineral layer). The shear plane may be produced a priori since the presence of the carbohydrate fulfils the role of a weak adhesive, in comparison with the potential adhesion of the slag to the internal wall of the slag pot or ladle.

Next, the mineral layer "stuck" to the internal wall of the slag pot or ladle is composed of fine mineral particles. The temperature of the slag pot or ladle, just before the slag is poured, has a temperature typically of 100° C. to 350° C. a temperature at which the mineral particles are stable. The mineral layer can therefore be applied to the slag pot or ladle well before use thereof. The slag pots or ladles thus coated can even be stored.

The dispersants or fluidifying agents, for example in a proportion of between 0% and 5%, preferably between 0.05% and 3%, more particularly between 0.1% and 2%, may for example be polymer or mineral additives such as for example anionic polymers or acidic polymers, boric acid and water-soluble salts of boric acid, such as for example alkaline metal borates, aluminium borates, $C_2$ to $C_{10}$ carboxylic acids, for example containing at least two acid groups and the salts thereof, such as for example alkaline metal salts or ammonium salts; hydroxide, carbonates, sulphates, nitrates, phosphates, or alkaline or ammonium metals.

The term "anionic polymer" used in the context of the present invention describes all polymers containing acid groups, in free form, neutralised or partially neutralised.

Examples of such anionic polymers that are suitable in the context of the present invention can be chosen from the commercially available anionic dispersants used for the production of mineral suspensions, such as:

homopolymers prepared using an acid monomer such as acrylic acid, methacrylic acid, maleic acid, maleic anhydride, fumaric acid, itaconic acid, itaconic anhydride, aconitic acid, crontonic acid, isocrotonic acid, mesaconic acid, vinyl acetic acid, hydroxyacrylic acid, undecylenic acid, allyl sulphonic acid, vinyl sulphonic acid, allyl phosphonic acid, vinyl phosphonic acid, 2-acrylomido-2-methyl propane sulphonic acid or 2-acrylamido glycolic acid;

copolymers prepared using at least one monomer in the group mentioned above and optionally one or more non-acid monomers such as for example acrylamide, acrylic acid esters, acrolein, methacrylic acid esters, maleic acid esters, itaconic acid esters, fumaric acid esters, vinyl acetate, acrylonitrile, styrene, alpha-methyl styrene, n-vinyl pyrrolidone, 2-hydroxyethyl acrylate, 2-hydroxyethyl methacrylate, dimethyl acrylamide, N-(hydroxymethyl)acrylamide or vinyl formamide.

These polymers may be in the form of free acid, alkaline metal salts, partially or entirely, mixed salts, soluble in water. The preferred ionic polymers are formed from acrylic acid with one or other of the monomers chosen from acrylamide, dimethyl acrylamide, methacrylic acid, maleic acid or AMPS (2-acrylamido-2-methylpropane sulphonic acid) in a preferred composition of 100:0 to 50:50 (by weight) and entirely neutralised in the form of a sodium salt.

In a particular embodiment of the present invention, said dispersant or fluidifying agent is a phosphate or a phosphonic acid chosen from organophosphonic acids, nitrogenated or not, or salts thereof, more particularly from the group consisting of amino alkylene polyphosphonic acids, where the alkylene radical contains 1 to 20 carbon atoms, hydroxy alkylidene phosphonic acids, where the alkylidine radical contains 2 to 50 carbon atoms, phosphono-alkanepolycarboxylic acids, where the alkane group contains from 3 to 12 carbon atoms and where the molar ratio of the alkyl phosphonic acid radical to the carboxylic acid radical is in the range 1:2 to 1:4, derivatives thereof, such as salts thereof, and mixtures thereof.

In another particular embodiment of the invention, said phosphonate or phosphonic acid comprises, in acid form, from 2 to 8, preferably from 2 to 6 characteristic "phosphonic acid" groups.

More particularly, said phosphonate or phosphonic acid is chosen from the group consisting of aminotris(methylenephosphonic) acid (ATMP), 1-hydroxyethylidene-1,1-diphosphonic acid (HEDP), ethylenediamine tetrakis(methylenephosphonic) acid (EDTMP), hexamethylenediamine tetrakis(methylenephosphonic) acid (HDTMP), diethylenetriamine pentakis(methylenephosphonic) acid (DTPMP), (2-hydroxy)ethylamino-N,N-bis(methylenephosphonic) acid (HEMPA), 2-phosphono-1,2,4-butanetricarboxylic acid (PBTC), 6-amino-1-hydroxyhexylene-N,N-diphosphonic acid (neridronic acid), N,N'-bis(3-aminopropyl)ethylenediamine hexakis(methylenephosphonic) acid, bis(hexamethylenediamine) pentakis(methylenephosphonic) acid, aminotris(methylenephosphonic) oxidic acid, derivatives thereof such as salts thereof and mixtures thereof.

In a particular embodiment of the present invention, said carbohydrate is chosen from the group consisting of disaccharides, such as sucrose or saccharose, sorbitol, monosaccharides, oligosaccharides, xylose, glucose, galactose, fructose, mannose, lactose, maltose, glucuronic acid, gluconic acid, erythritol, xylitol, lactitol, maltitol, dextrins, cyclodextrins, inulin, glucitol, uronic acid, rhamnose, arabinose, erythrose, threose, ribose, allose, trehalose, galacturonic acid, and mixtures thereof.

In a particularly preferred embodiment of the method according to the present invention, said carbohydrate is chosen from the group consisting of disaccharides, such as sucrose or saccharose, sorbitol and mixtures thereof.

Apart from the aspect of the reduced cost of these carbohydrates, combined with their perfect compatibility with the milk-of-lime, these carbohydrates are known to reduce the viscosity of the milk-of-lime and to keep it low over time, consequently facilitating the storage conditions of the milk-of-lime.

In one embodiment of the method according to the present invention, said calcic particle milk has a viscosity between 0.1 Pa·s and 2 Pa·s, that is to say between 100 cps and 2000 cps. Advantageously, the viscosity is greater than 0.15 Pa·s and less than 1 Pa·s, preferably less than 0.6 Pa·s, more preferentially less than 0.5 Pa·s, even more preferentially less than 0.3 Pa·s.

The viscosity of a milk-of-lime is a determining property with regard to use and manipulation (pumping, transport in a pipe, etc.) of the suspension. To this end, experience has made it possible to establish that the dynamic viscosity of the suspension must be less than 2 Pa·s (U.S. Pat. No. 5,616,283) and that it is desirable not to exceed a dynamic viscosity of 1.5 Pa·s (WO 2007/110401).

The viscosity in the context of the present invention is measured by means of a Brookfield type DV-III viscometer (rheometer) at 100 revolutions/min (rpm) using an LV No. 3 needle.

In yet another variant of the present invention, said calcic particles of the calcic particle milk have a $d_{97}$ particle size of between 7 and 100 μm.

Advantageously, said calcic particles of the calcic particle milk have a $d_{97}$ particle size greater than or equal to 10 μm and less than or equal to 20 μm, in particular less than or equal to 15 μm.

More particularly, in the method according to the present invention, said calcic particle milk has a calcic particle content greater than or equal to 25% by weight, preferably greater than or equal to 27% by weight, preferably greater than or equal to 30% by weight, and preferably greater than or equal to 35% by weight, with respect to the total weight of the calcic particle milk, and a calcic particle content of less than or equal to 55% by weight, preferably less than or equal to 50% by weight, preferably less than or equal to 48% by weight, with respect to the total weight of the calcic particle milk.

Particularly advantageously, in the method according to the present invention, said mineral layer, coated on the internal wall, has a layer thickness of between 0.1 and 5 mm, preferably between 0.15 and 3 mm, more preferentially between 0.2 and 2 mm, in particular between 0.5 and 1 mm.

Other embodiments of the method according to the invention are indicated in the accompanying claims.

Another subject matter of the invention is a use of a milk of calcic particles chosen from the group consisting of slaked lime, at feast partially slaked decarbonated dolomite, limestone and mixtures thereof for lining an internal wall of a slag pot or ladle made from steel or cast iron with a mineral layer of calcic particle milk, in which said calcic particle milk is sprayed and has a calcic particle content of between 20% and 60% by weight with respect to the total weight of the calcic particle milk.

Advantageously, said mineral layer of calcic particle milk has a layer thickness of between 0.1 and 5 mm, preferably between 0.15 and 3 mm, more preferentially between 0.2 and 2 mm, in particular between 0.5 and 1 mm.

According to a preferred use, the calcic particle milk is a milk-of-lime and said calcic particles are slaked lime particles.

More particularly, said calcic particles of said mineral suspension have a mean particle size $d_{50}$ between 1.5 μm and 10 μm.

Advantageously, said calcic particles in the calcic particle milk of said mineral suspension have a mean particle size $d_{50}$ of less than or equal to 8 μm, in particular less than or equal to 6 μm, more particularly less than or equal to 5 μm, quite particularly less than 4 μm.

Advantageously, said calcic particles in the calcic particle milk of said mineral suspension have a mean particle size $d_{50}$ greater than or equal to 2 μm, in particular greater than or equal to 2.5 μm.

According to a preferential use of the present invention, said additives of said mineral suspension are chosen from the group consisting of carbohydrates, dispersants, fluidifying additives, such as polycarbonates or polyacrylates, or polyphosphonates, in particular DTPMP.

According to a more preferential use of the present invention, said carbohydrate is chosen from the group consisting of disaccharides, such as sucrose or saccharose, sorbitol, monosaccharides, oligosaccharides, xylose, glucose, galactose, fructose, mannose, lactose, maltose, glucuronic acid, gluconic acid, erythritol, xyiltol, lactitol, maltitol, dextrins, cyclodextrins, inulin, glucitol, uronic acid, rhamnose, arabinose, erythrose, threose, ribose, allose, trehalose, galacturonic acid, and mixtures thereof.

More particularly, said carbohydrate is chosen from the group consisting of disaccharides, such as sucrose or saccharides, sorbitol and mixtures thereof.

Preferably, according b the present invention, said calcic particle milk has a viscosity of between 0.1 Pa·s and 2 Pa·s.

In a preferential use of the present invention, said calcic particles of the calcic particle milk have a particle size of between 7 and 100 μm.

Advantageously, according to the present invention, said calcic particle milk has a calcic particle content of greater than or equal to 25% by weight, preferably greater than or equal to 27% by weight, preferably greater than or equal to 30% by weight, and preferably greater than or equal to 35% by weight, with respect to the total weight of the calcic particle milk, and a calcic particle content of less than or equal to 55% by weight, preferably less than or equal to 50% by weight, preferably less than or equal to 48% by weight, with respect to the total weight of the calcic particle milk.

Other embodiments according to the present invention are mentioned in the accompanying claims.

The present invention also relates to a method for handling a pyrometallurgical tool comprising an internal wall and an external wall, said method comprising the steps of a) use of said pyrometallurgical tool, b) cleaning of said pyrometallurgical tool, c) spraying of a mineral suspension onto said internal wall and/or onto said external waif of said pyrometallurgical tool, prior to at least one step of use of said pyrometallurgical tool, so as to line said internal wall and/or said external wall with a mineral layer, and d) bringing said pyrometallurgical tool into service, said internal wall and/or said external wall of which is lined with said mineral layer with a view to use a) thereof.

Said external wall is sometimes also referred to as a shell.

This method is characterised in that said pyrometallurgical tool is a tool made from steel or cast iron and in that said mineral suspension comprises calcic particles in suspension in an aqueous phase forming a calcic particle milk, and optionally additives, said calcic particles being chosen from the group consisting of slaked lime, at least partially slaked decarbonated dolomite, limestone and mixtures thereof and having a calcic particle content of between 20% and 60% by weight with respect to the weight of said calcic particle milk, said mineral layer being a fine layer.

As can be seen, the method according to the present invention focuses on pots made from steel or cast iron.

This is because, in the context of the present invention, the choice relating to slag pots or ladles made from steel or cast iron (rather than from refractory material) makes it possible to take best advantage of the difference in coefficient of expansion between materials of the metallic type forming slag pots or ladles and slag oxides.

When the milk of calcic particles chosen exclusively from the small group consisting of slaked lime, at least partially slaked decarbonated dolomite, limestone and mixtures thereof has a calcic particle content of between 20 and 60% by weight, with respect to the total weight of the calcic particle milk, is lined on the internal wall or the external wall of the pyrometallurgical tools, a fine homogeneous mineral layer forms, and it was remarked surprisingly that the frequency of maintenance of these pyrometallurgical tools was significantly reduced and easier.

In a particular embodiment according to the present invention, the calcic particle milk is a milk-of-lime and said calcic particles are particles of slaked lime.

Advantageously, said calcic particles in the calcic particle milk of said mineral suspension have a mean particle size $d_{50}$ of between 1.5 μm and 10 μm.

Advantageously, said calcic particles in said calcic particle milk of said mineral suspension have a mean particle size $d_{50}$ of less than or equal to 8 μm, in particular less than or equal to 6 μm, more particularly less than or equal to 5 μm, quite particularly less than 4 μm.

Advantageously, said calcic particles in said calcic particle milk of said mineral suspension have a mean particle size $d_{50}$ greater than or equal to 2 μm, in particular greater than or equal to 2.5 μm.

The notation $d_x$ represents a diameter, expressed in μm, with respect to which X % of the particles or grains measured are smaller.

The finer the particles, the better the reaction releasing steam or $CO_2$, which allows shedding of the slag as indicated previously.

The reactivity of the milks-of-lime is characterised, within the meaning of the present invention, according to the European standard EN 12485 (2010)§ 6.11 ("Determination of solubility index by conductivity". This method is itself derived from the work by van Eekeren et al disclosed in the document "Improved milk-of-lime for softening of drinking water", M. W. M. van Eekeren, J. A. M. van Paassen, C. W. A. M. Merks. KIWA NV Research and Consultancy, Nieuwegein, September 1993" produced and distributed by KIWA, Royal Netherland Water Analysis Institute (KIWA NV Research and Consultancy, Groningenhaven 7, PO Box 1072, 3430BB Nieuwegein).

The reactivity of a milk-of-lime is therefore assessed by the change over time in the measurement of the conductivity of a solution prepared by diluting a small quantity of milk-of-lime in a large volume of demineralised water. The points corresponding to a conductivity of x % for x %=63%, 80%, 90% and 95% of the maximum conductivity at the end point are in particular noted (see EN 12485 (2010) § 6.11.6.2). The corresponding dissolution time t(x %) in seconds is then obtained from the conductivity against time graph (see FIG. 2 of EN 12485 (2010)).

It is known that the rate of dissolution of lime particles in demineralised water is faster (t(x %) smaller) when the size of the particles is smaller. In other words, the reactivity of the milk-of-lime is generally higher when its constituent particles are smaller.

In a preferred embodiment of the method according to the present invention, when said mineral suspension contains or is milk-of-lime, it has a reactivity expressed in the form of a dissolution time t(90%) greater than 0.1 seconds, in particular greater than 0.2 seconds and less than 10 seconds, in particular less than 5 seconds.

When the milk-of-lime has such reactivity, the slaked-lime particles have a particle size that is sufficiently fine for also contributing to the formation of a fine mineral layer, in particular homogeneous, participating in the simplification of the stripping of the slag.

The stability of the calcic particle milk or of the mineral suspension can be determined using the stability method referred to as the bottle test as described in the document WO 2001/096240.

Preferably, said additives of said mineral suspension are chosen from the group consisting of carbohydrates as well as dispersants and fluidifying additives and mixture thereof, such as polycarbonates or polyacrylates, or polyphosphonates, in particular DTPMP.

The dispersants or fluidifying agents that can be used in the context of the present invention have been mentioned previously.

Naturally a plurality of the aforementioned additives may be present in said mineral suspension, in particular one or more carbohydrates with one or more dispersants or fluidifiers.

In a particular embodiment of the present invention, said carbohydrate is chosen from the group consisting of disaccharides, such as sucrose or saccharose, sorbitol, monosaccharides, oligosaccharides, xylose, glucose, galactose, fructose, mannose, lactose, maltose, glucuronic acid, gluconic acid, erythritol, xylitol, lactitol, maltitol, dextrins, cyclodextrins, inulin, glucitol, uronic acid, rhamnose, arabinose, erythrose, threose, ribose, allose, trehalose, galacturonic acid, and mixtures thereof.

In a particularly preferred embodiment of the method according to the present invention, said carbohydrate is chosen from the group consisting of disaccharides, such as sucrose or saccharose, sorbitol and mixtures thereof.

Apart from the aspect of the reduced cost of these carbohydrates, combined with their perfect compatibility with the milk-of-lime, these carbohydrates are known to reduce the viscosity of the milk-of-lime and to keep it low over time, consequently facilitating the storage conditions of the milk-of-lime.

In one embodiment of the method according to the present invention, said calcic particle milk has a viscosity between 0.1 Pa·s and 2 Pa·s that is to say between 100 cps and 2000 cps.

The viscosity of a milk-of-lime is a determining property with regard to use and manipulation (pumping, transport in a pipe, etc.) of the suspension. To this end, experience has made it possible to establish that the dynamic viscosity of the suspension must be less than 2 Pa·s (U.S. Pat. No. 5,616,283) and that it is desirable not to exceed a dynamic viscosity of 1.5 Pa·s (WO 2007/110401).

The viscosity in the context of the present invention is measured by means of a Brookfield type DV-III viscometer (rheometer) at 100 revolutions/min (rpm) using an LV No. 3 needle.

In yet another variant of the present invention, said calcic particles of the calcic particle milk have a $d_{97}$ particle size of between 7 and 100 μm.

More particularly, in the method according to the present invention, said calcic particle milk has a calcic particle content greater than or equal to 25% by weight, preferably greater than or equal to 27% by weight, preferably greater than or equal to 30% by weight, preferably greater than or equal to 35% by weight, with respect to the total weight of the calcic particle milk, and a calcic particle content of less than or equal to 55% by weight, preferably less than or equal to 50% by weight, preferably less than or equal to 48% by weight, with respect to the total weight of the calcic particle milk.

Particularly advantageously, in the method according to the present invention, said mineral layer, coated on the internal wall, has a layer thickness of between 0.1 and 5 mm, preferably between 0.15 and 3 mm, more preferentially between 0.2 and 2 mm, in particular between 0.5 and 1 mm.

Other embodiments of the method according to the present invention are indicated in the accompanying claims.

Finally, the present invention relates to a use of a milk of calcic particles chosen from the small group consisting of slaked lime, at least partially slaked decarbonated dolomite, limestone and mixtures thereof for lining with a mineral layer an internal wall and/or an external wall of a pyrometallurgical tool made from steel or cast iron in order to reduce the frequency of handling of said pyrometallurgical tool, wherein said calcic particle milk is sprayed and has a calcic particle content between 20% and 60% by weight, with respect to the total weight of the calcic particle milk.

Advantageously, said mineral layer of milk-of-lime has a layer thickness of between 0.1 and 5 mm, preferably between 0.15 and 3 mm, more preferentially between 0.2 and 2 mm, in particular between 0.5 and 1 mm.

According to a preferred use, the calcic particle milk is a milk-of-lime and said calcic particles are particles of slaked lime.

More particularly, said calcic particles of said mineral suspension have a mean particle size $d_{50}$ of between 1.5 μm and 10 μm.

Advantageously, said calcic particles in the calcic particle milk of said mineral suspension have a mean particle size $d_{50}$ of less than or equal to 8 μm, in particular less than or equal to 6 μm, more particularly less than or equal to 5 μm, quite particularly less than 4 μm.

Advantageously, said calcic particles in the calcic particle milk of said mineral suspension have a mean particle size $d_{50}$ greater than or equal to 2 μm, in particular greater than or equal to 2.5 μm.

According to a preferential use of the present invention, said additives of said mineral suspension are chosen from the group consisting of carbohydrates as well as dispersants and fluidifying additives, such as polycarbonates or polyacrylates, or polyphosphonates, in particular DTPMP.

Naturally a plurality of aforementioned additives may be present in said mineral suspension, in particular one or more carbohydrates with one or more dispersants or fluidifiers.

According to a more preferential use of the present invention, said carbohydrate is chosen from the group consisting of disaccharides, such as sucrose or saccharose, sorbitol, monosaccharides, oligosaccharides, xylose, glucose, galactose, fructose, mannose, lactose, maltose, glucuronic acid, gluconic acid, erythritol, xylitol, lactitol, maltitol, dextrins, cyclodextrins, inulin, glucitol, uronic acid, rhamnose, arabinose, erythrose, threose, ribose, allose, trehalose, galacturonic acid, and mixtures thereof.

More particularly, said carbohydrate is chosen from the group consisting of disaccharides, such as sucrose or saccharides, sorbitol and mixtures thereof.

Preferably, according to the present invention, said calcic particle milk has a viscosity of between 0.1 Pa·s and 2 Pa·s.

In a preferential use of the present invention, said calcic particles of the calcic particle milk have a $d_{97}$ particle size of between 7 and 100 μm.

Advantageously, according to the present invention, said calcic particle milk has a calcic particle content of greater than or equal to 25% by weight, preferably greater than or equal to 27% by weight, preferably greater than or equal to 30% by weight, and preferably greater than or equal to 35% by weight, with respect to the total weight of the calcic particle milk, and a calcic particle content of less than or equal to 55% by weight, preferably less than or equal to 50% by weight, preferably less than or equal to 48% by weight, with respect to the total weight of the calcic particle milk.

Other forms of use according to the present invention are mentioned in the accompanying claims.

Other features, details and advantages of the invention will emerge from the description given below, non-limitatively.

Naturally the present invention is in no way limited to the embodiments described above and many modifications can be made thereto without departing from the scope of the accompanying claims.

The invention claimed is:

1. A method for handling a slag pot or ladle being a steel or cast-iron pot or ladle comprising an internal wall and an external wall, said method comprising the steps of:

a) spraying a mineral suspension on said internal wall, the temperature of said slag pot or ladle being greater than 100° C., so as to line said internal wall with a mineral layer, prior to the steps of:

b) collecting slag in said slag pot or ladle, lined on its internal wall with said mineral layer, of a pyrometallurgic tool, c) transporting said slag pot or ladle from said pyrometallurgic tool to a slag deposition site, d) emptying said slag pot or ladle at said slag-deposition site in order to eliminate the slag contained in said pot or ladle, e) wherein step a) is performed with the purpose of bringing said slag pot or ladle lined with said mineral layer into service in order to repeat steps b) to d), and wherein said mineral suspension comprises calcic particles in suspension in an aqueous phase forming a calcic-particle milk, said calcic particles being chosen from the group consisting of slaked lime, at least partially slaked decarbonated dolomite, limestone and mixtures thereof, the at least partially slaked decarbonated dolomite being obtained from decarbonated dolomite, the decarbonated dolomite having a quick part caused by the release of $CO_2$ during cooking, the at least partially slaked decarbonated dolomite being obtained by adding water in order to hydrate the quick part of the decarbonated dolomite, the mineral suspension having a calcic particle content of between 20% and 60% by weight with respect to the weight of said calcic-particle milk, said calcic particles in the calcic particle milk of said mineral suspension having a mean particle size $d_{50}$ of between 1.5 μm and 10 μm and wherein said mineral layer is a fine layer coated on the internal wall, the layer having a layer thickness of between 0.1 and 0.5 mm, in which said mineral suspension further comprises additives, selected from the group consisting of carbohydrates, dispersants and fluidifying additives and wherein said dispersants and fluidifying additives are selected from the group consisting of polycarbonates, polyacrylates and polyphosphonates.

2. The method of claim 1, in which said additive is selected from the group consisting of sucrose, saccharose, sorbitol, xylose, glucose, galactose, fructose, mannose, lactose, maltose, glucuronic acid, gluconic acid, erythritol, xylitol, lactitol, maltitol, dextrins, cyclodextrins, inulin, glucitol, uronic acid, rhamnose, arabinose, erythrose, threose, ribose, allose, trehalose, galacturonic acid, and mixtures thereof.

3. The method of claim 2, in which said additive is selected from the group consisting of sucrose, saccharose, sorbitol and mixtures thereof.

4. The method of claim 1, in which said calcic particle milk has a viscosity of between 0.1 Pa·s and 2 Pa·s.

5. The method of claim 1, in which said calcic particles of the calcic particle milk have a particle size $d_{97}$ of between 7 and 100 μm.

6. The method of claim 1, in which said calcic particle milk is a milk-of lime and said calcic particles are slaked lime particles, and in which said milk-of-lime has a reactivity expressed in the form of a dissolution time t(90%) greater than 0.1 seconds and less than 10 seconds.

7. The method of claim 1, in which said calcic particle milk has a calcic particle content greater than or equal to 25% by weight with respect to the total weight of the calcic particle milk, and a calcic particle content of less than or equal to 55% by weight with respect to the total weight of the calcic particle milk.

8. A method for lining an internal wall of a slag pot or ladle made from steel or cast iron with a mineral layer of calcic particle milk using a milk, wherein the milk of calcic particles is selected from the group consisting of slaked lime, at least partially slaked decarbonated dolomite, limestone and mixtures thereof, the at least partially slaked decarbonated dolomite being obtained from decarbonated dolomite, the decarbonated dolomite having a quick part caused by the release of $CO_2$ during cooking, the at least partially slaked decarbonated dolomite being obtained by adding water in order to hydrate the quick part of the decarbonated dolomite, in which said calcic particle milk is sprayed to form a fine mineral layer of calcic particles and has a calcic particle content of between 20% and 60% by weight with respect to the total weight of the calcic particle milk, said fine mineral layer of calcic particles having a layer thickness of between 0.1 and 0.5 mm and said calcic particles of said mineral suspension having a mean particle size $d_{50}$ of between 1.5 μm and 10 μm.

9. The method of claim 8, in which said mineral suspension further comprises an additive selected from the group consisting of carbohydrates, dispersants and fluidifying additives, and wherein said dispersants and fluidifying additives are selected from the group consisting of polycarbonates, polyacrylates, and polyphosphonates.

10. The method of claim 9, in which said additive is selected from the group consisting of sucrose, saccharose, sorbitol, xylose, glucose, galactose, fructose, mannose, lactose, maltose, glucuronic acid, gluconic acid, erythritol, xylitol, lactitol, maltitol, dextrins, cyclodextrins, inulin, glucitol, uronic acid, rhamnose, arabinose, erythrose, threose, ribose, allose, trehalose, galacturonic acid, and mixtures thereof.

11. The method of claim 9, in which said additives are selected from the group consisting of sucrose, saccharose, sorbitol and mixtures thereof.

12. The method of claim 8, in which said calcic particle milk has a viscosity of between 0.1 Pa·s and 2 Pa·s.

13. The method of claim 8, in which said calcic particles of the calcic particle milk have a particle size $d_{97}$ of between 7 and 100 μm.

14. The method of claim 8, in which said calcic particle milk has a calcic particle content greater than or equal to 25% by weight with respect to the total weight of the calcic particle milk, and a calcic particle content of less than or equal to 55% by weight with respect to the total weight of the calcic particle milk.

* * * * *